US006874827B1

(12) United States Patent
Dodson

(10) Patent No.: US 6,874,827 B1
(45) Date of Patent: Apr. 5, 2005

(54) TEMPORARY LATCHES

(75) Inventor: Richard Lee Dodson, Tulsa, OK (US)

(73) Assignee: Premiere Lock Co., L.L.C., Tulsa, OK (US)

( * ) Notice: Subject to any disclaimer, the term of this patent is extended or adjusted under 35 U.S.C. 154(b) by 0 days.

(21) Appl. No.: 10/615,813

(22) Filed: Jul. 9, 2003

(51) Int. Cl.[7] ..... E05C 19/00
(52) U.S. Cl. ..... 292/175; 292/288; 292/1
(58) Field of Search ..... 292/1, 288, 163, 292/175, DIG. 2

(56) References Cited

U.S. PATENT DOCUMENTS 2,775,475 A * 12/1956 Miller ..... 292/1
3,343,860 A * 9/1967 Kohler ..... 292/169.16
3,724,889 A * 4/1973 Dooley ..... 292/87
4,109,948 A 8/1978 Potter et al.
4,169,618 A 10/1979 Potter et al.
4,848,813 A * 7/1989 Fildan ..... 292/167
6,357,181 B1 * 3/2002 Triemstra ..... 49/380
6,485,069 B1 * 11/2002 Anderson ..... 292/175

FOREIGN PATENT DOCUMENTS

GB 2 231 612 A * 11/1990

* cited by examiner

*Primary Examiner*—Gary Estremsky
(74) *Attorney, Agent, or Firm*—Molly D. McKay

(57) ABSTRACT

The present invention is a temporary latch for use in an installed door until the permanent latch for the door can be installed. The temporary latch consists of two pieces, i.e. a handle portion with tabs and a tongue portion with slots. The two pieces removably secure together within a door latch opening provided in the door by rotating the tongue portion so that the tabs of the handle portion are reversibly locked in the slots of the handle portion. The handle portion is provided with a ring for grasping and a compressible arm that retracts causing the tongue portion to be withdrawn into the door latch opening as the door is being closed and when the door is being unlocked from its door frame.

9 Claims, 4 Drawing Sheets

TEMPORARY LATCHES

BACKGROUND OF THE INVENTION

1. Field of the Invention

The present invention relates to temporary latches for use in door latch openings of doors prior to permanent latches being installed in the doors. Each temporary latch allows the door to be latched in a closed position during construction of the building in which the door is installed. By securing the door in a closed position without the need to resort to inserting wood pegs or nails into the door latch opening, the present invention thereby reduces the chance that the door, the door jam, and/or the door hinges will be damaged by the workmen.

2. Description of the Related Art

During the construction of a building, the doors for the building are normally installed without door latches and the permanent door latches usually are installed in the doors much later in the construction of the building. Between the time the doors are installed in the building and the time the permanent latches are installed in the doors, workmen often accidentally damage the doors, the door hinges, and/or the door frames. Damage can occur in one of several different ways.

First, because there is no way to latch the doors shut prior to installation of the permanent door latches, the doors may swing freely and can be bumped and damaged by the workmen or their equipment as the workmen go about their job of constructing the building. Workmen can also be injured or have their equipment damaged during such encounters with free swinging doors.

For this reason, the workmen who are working in the building that is under construction may try to devise a way to latch or otherwise secure the doors by using nails, pieces of wood, or other items that they might have at hand. These items are inserted into the door latch openings, under the doors, or against the doors to try to hold the doors shut. Any of these improvised latching means can scar or damage the door, the door jam or frame, or the hinges of the door. Damage to a door, door frame, or hinge normally must be repaired to the building owner's satisfaction or the damaged item must be replaced. In the case of decorative wood or wood and glass doors, repair may not be possible and replacement can be extremely expensive.

The present invention is designed to meet this need by providing inexpensive yet durable temporary latches that can function to latch and unlatch doors at a building site prior to the installation of the permanent door latches. The present temporary latches are reusable and easy to install and remove from the doors. They are also easy to operate to latch and unlatch the doors. These temporary latches hold the doors shut and thereby reduce the chance of the doors, door jams, and hinges from being damaged during construction of the building. In addition, use of these temporary door latches makes the building site safer for the workmen.

SUMMARY OF THE INVENTION

The present invention is a temporary latch for use in a door after the door is installed in a building and before the permanent latch for the door is installed. The temporary latch consists of two pieces, i.e. a handle portion and a tongue portion, that removably secure together within a door latch opening provided in a door in which the temporary latch is to be installed.

A door latch opening consists of two bores that are drilled into the door. The first and larger bore is drilled through the door so that the larger bore extends between the two sides of the door and is located approximately 2¾, or alternately, approximately 2⅜ inches from the front edge of the door. The second and smaller bore is drilled into the door so that it intersects with the first bore. It is drilled perpendicular to the larger bore and extends from the front edge of the door to the larger bore.

To install the temporary latch into the door latch opening, the tongue portion of the temporary latch is first disengaged from the handle portion. Then the handle portion of the temporary latch is inserted into the larger bore of the door latch opening from one side of the two sides of the door. The handle portion is positioned within the door latch opening so that a cylindrical front end of the handle portion extends into the smaller bore and the ears provided on a rear end of the handle portion engage the door on both sides of the door at the larger bore. In order to thus position the handle portion in the door latch opening, the cylindrical front end of the handle portion must first be inserted into the smaller bore via the larger bore.

Then a compressible arm that has ears provided on a rear end of the arm is biased toward a ring that is sandwiched between the cylindrical front end and the compressible arm. With the compressible arm held in this compressed position, the ring and compressible arm may then be pushed into the larger bore. Once the handle portion is thus positioned within the door latch opening, the compressible arm is released and the arm springs rearward. As the arm springs rearward within the large bore, the ears engage the two sides of the door at the larger bore, thus securing the handle portion within the door latch opening.

Next, a rear end of the tongue portion is inserted into the smaller bore via the front edge of the door. The rear end of the tongue portion is cylindrical and hollow. The rear end of the tongue portion is provided with a pair of elongated slots therein so that the elongated slots are provided on opposite sides of the cylindrical rear end of the tongue portion. Each elongated slot extends completely through the wall of the rear end of the tongue portion and is parallel with the longitudinal axis of the tongue portion. Each slot is provided with three intersecting slots that also extend completely through the wall of the rear end of the tongue portion. The three slots are approximately perpendicular to their associated elongated slot and are spaced equal distances apart from each other. The three slots associated with each elongated slot are located in a clockwise orientation to their associated elongated slots.

Before the rear end of the tongue portion is inserted into the smaller bore, it is turned approximately 90 degrees from its normal orientation, i.e. with the angled portion of the tongue facing downward instead of toward the door frame. This orientation is necessary so that, as the tongue portion inserts into the smaller bore, the cylindrical front end of the handle portion is telescopically received within the hollow rear end of the tongue portion and two longitudinally aligned tabs provided on each side of the cylindrical front end of the handle portion are received in the elongated slots.

The tongue portion is inserted into the smaller bore until a tongue that is provided on a front end of the tongue portion is in the proper position within the door latch opening, i.e. with an angled portion of the tongue located at the front edge of the door. When the tongue portion is inserted in the proper position relative to the door, the tongue portion is rotated clockwise so that the two tabs on each side of the handle portion move into two of the three intersecting slots provided associated with each elongated slot.

The tabs will enter either the first two of the three intersection slots or the last two of the three intersecting slots depending on whether the larger bore is located approximately 2⅜ or 2¾ inches from the front edge of the door. These are the most common bore depths in use for doors, but the invention is not so limited and could be made to fit any bore depths. When the tabs enter the intersecting slots, this locks the tongue portion to the handle portion and rotates the angled portion of the tongue to the proper orientation relative to the door frame. This completes the installation of the temporary latch in the door latch opening.

The door frame is provided with tongue receiving opening that is vertically aligned with the tongue and into which the tongue inserts to thereby latch the door in a closed position. To lock the door closed with the temporary latch, the door is simply closed. As the door closes, the angled portion of the tongue strikes the door frame and due to the angled orientation of the angled portion, the tongue portion is moved rearward. This causes the arm to be compressed and allows the tongue to move rearward into the small bore so that the front end of the tongue is flush with the edge of the door as the door completely closes in its associated door frame.

As the door closes, the tongue encounters the tongue receiving opening provided in the door frame, and the compressed arm biases the tongue forward into the tongue receiving opening. Once the tongue enters the tongue receiving opening, the door is latched shut in its locked or closed position.

In order to open the door, the operator must grasp the ring or circular portion of the handle and bias the handle rearward within the large bore. This causes the tongue to be retracted within the small bore, unlocking the door so that it can be swung open. When the operator releases the circular portion, the arm biases the tongue forward so that the angled portion again extends beyond the front edge of the door. Shoulders of the circular portion that extend upward and downward within the large bore prevent the circular portion from entering the smaller bore, and thereby properly positioning the tongue so that it does not extend too far beyond the front edge of the door.

To remove the temporary door latch from the door so that a permanent door latch can be installed in the door, the tongue portion of the temporary latch is first disengaged from the handle portion by rotating the tongue portion counterclockwise until the two tabs on each side of the handle portion move out of the intersecting slots and into the elongated slot. Once the tabs are in the elongated slots, the tongue portion is then removed from the smaller bore by pulling the tongue portion out of the smaller bore via the front edge of door.

Once the tongue portion has been removed from the door, the handle portion is removed from the larger bore by first biasing the compressible arm toward the ring so that the ears on the compressible arm can be disengaged from the larger bore and then the handle portion can be pulled out of the larger bore on either side of the door.

DETAILED DESCRIPTION OF THE PREFERRED EMBODIMENT THE INVENTION

Figure 1:
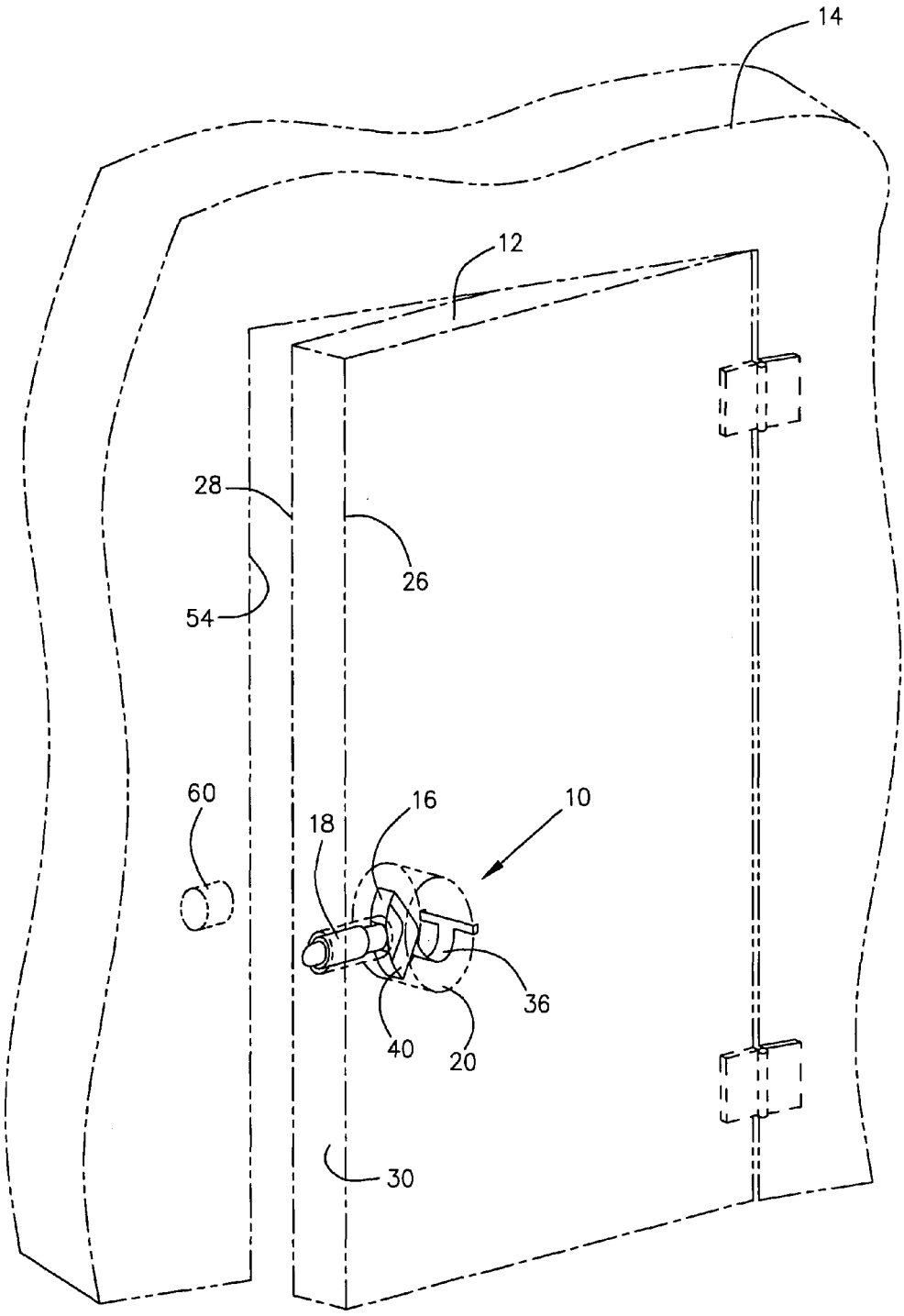
FIG. 1 is a perspective view of a temporary latch constructed in accordance with a preferred embodiment of the present invention, shown in use in a door latch opening of a door.
Figure 6:
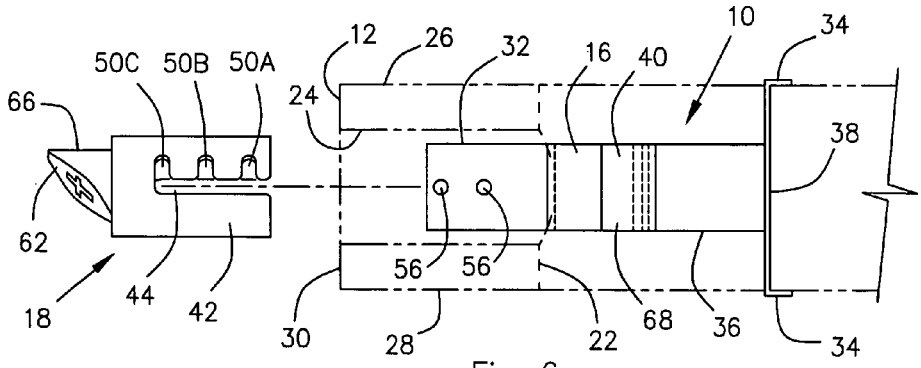
FIG. 6 is an exploded top view of the temporary latch showing the handle portion located within the door and showing the tongue portion in the proper rotational position to be inserted into the door and onto the handle portion.

Referring now to the drawings, and initially to FIG. 1, there is illustrated a temporary latch 10 for use in a door 12 after the door 12 is installed in a building 14 for use until a permanent latch for the door 12 can be installed. Referring now to FIG. 6, the temporary latch 10 consists of two pieces, i.e. a handle portion 16 and a tongue portion 18. The two portions 16 and 18 removably secure together within a door latch opening 20 provided in the door 12 in which the temporary latch 10 is to be installed.

A door latch opening 20 consists of two intersecting bores 22 and 24 that are drilled into the door 12. The larger bore 22 is drilled through the door 12 so that the larger bore 22 extends between the two sides 26 and 28 of the door 12 and so that the larger bore 22 is located either approximately 2¾ inches or alternately 2⅜ inches from the front edge 30 of the door 12.

The smaller bore 24 intersects with the larger bore 22. The smaller bore 24 is drilled perpendicular to the larger bore 22 and extends from the front edge 30 of the door 12 to terminate where it intersects with the larger bore 22.

To install the temporary latch 10 into the door latch opening 20, the tongue portion 18 of the temporary latch 10 is first disengaged from the handle portion 16. This is accomplished by rotating the tongue portion 18 relative to the handle portion 16 and then pulling the tongue portion 18 away from the handle portion 16.

Figure 8:
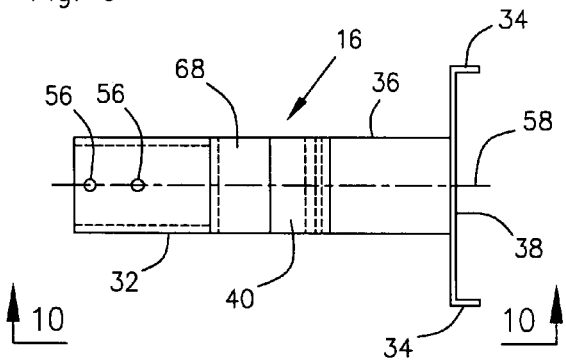
FIG. 8 is a top view of the handle portion.
Figure 10:
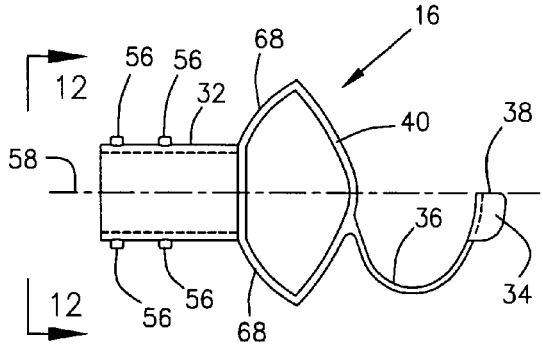
FIG. 10 is a side view of the handle portion taken along line 10—10 of FIG. 8.
Figure 12:
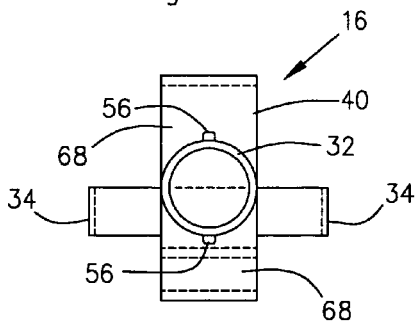
FIG. 12 is a front end view of the handle portion taken along line 12— 12 of FIG. 10.

Then the handle portion 16 of the temporary latch 10 is inserted into the larger bore 22 of the door latch opening 20 from one side 26 or 28 of the door 12. As illustrated in FIGS. 8, 10, and 12, the handle portion 16 is provided with a cylindrical front end 32, a compressible arm 36 at its rear end 38, and a ring 40 located between the cylindrical front end 32 and the compressible arm 36. Two outwardly extending ears 34 are provided at the rear end 38 on the compressible arm 36, with one ear 34 on either side of the arm 36.

The handle portion 16 is compressible in order to allow the handle portion 16 to be inserted into the door latch opening 20. Once the handle portion 16 is compressed, the handle portion 16 is positioned within the door latch opening 20 so that a cylindrical front end 32 of the handle portion 16 extends into the smaller bore 24 and ears 34 that are provided on a compressible arm 36 located at the rear end 38 of the handle portion 16 engage the door 12 on both sides 26 and 28 of the door 12 at the larger bore 22.

In order to thus position the handle portion 16 in the door latch opening 20, the cylindrical front end 32 must first be inserted into the smaller bore 24 via the larger bore 22 and then the compressible arm 36 is biased toward a ring 40 that is sandwiched between the cylindrical front end 32 and the compressible arm 36 so that the ring 40 and compressible arm 36 may enter the larger bore 22. Once the handle portion 16 is thus positioned within the door latch opening 20, the compressible arm 36 is released and the arm 36 springs rearward. As the arm 36 springs rearward within the larger bore 22, the ears 34 engage the two sides 26 and 28 of the door 12 at the larger bore 22, thus securing the handle portion 16 within the door latch opening 20.

Figure 7:
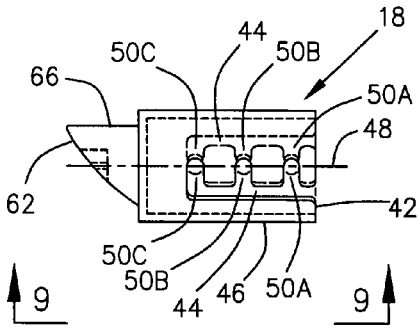
FIG. 7 is a top view of the tongue portion.
Figure 9:
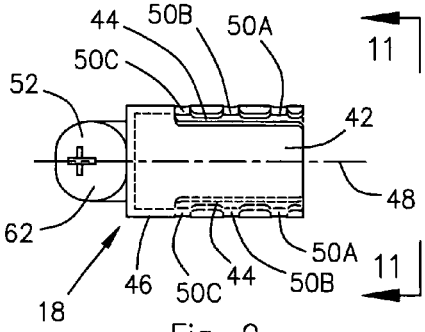
FIG. 9 is a side view of the tongue portion taken along line 9—9 of FIG. 7.
Figure 11:
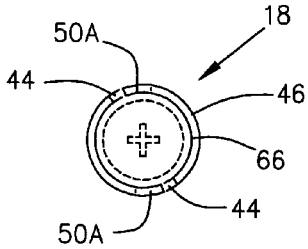
FIG. 11 is a rear end view of the tongue portion taken along line 11—11 of FIG. 9.

Next, a rear end 42 of the tongue portion 18 is inserted into the smaller bore 24 via the front edge 30 of the door 12. As illustrated in FIGS. 7, 9 and 11, the rear end 42 of the tongue portion 18 is cylindrical and hollow. The rear end 42 of the tongue portion 18 is provided with a pair of elongated slots 44 therein so that the elongated slots are provided on opposite sides of the cylindrical rear end 42 of the tongue portion 18. Each elongated slot 44 extends completely through the wall 46 of the rear end 42 of the tongue portion 18 and is parallel with a longitudinal axis 48 of the tongue portion 18.

Each elongated slot 44 is provided with three intersecting slots 50A, 50B and 50C that also extend completely through the wall 46 of the rear end 42 of the tongue portion 18. The three intersecting slots 50A, 50B and 50C are provided approximately perpendicular to their associated elongated slot 44 so that they are continuous with their associated elongated slot 44 and are spaced equal distances apart from each other.

As illustrated in FIG. 6, before the rear end 42 of the tongue portion 18 is inserted into the smaller bore 24, it is turned approximately 90 degrees from its normal orientation, i.e. with an angled portion 52 facing downward instead of in its normal orientation with the angle portion facing toward the door frame as illustrated in FIG. 1. As the tongue portion 18 is inserted into the smaller bore 24, the cylindrical front end 32 of the handle portion 16 is telescopically received within the hollow rear end 42 of the tongue portion 18 and two tabs 56 that are provided on each side of the cylindrical front end 32 of the handle portion 16 are received in the elongated slots 44. The two tabs 56 are aligned with each other and are parallel with a longitudinal axis 58 of the cylindrical front end 32 of the handle portion 16.

The tongue portion 18 is inserted into the smaller bore 24 until the angled portion 52 is in the proper position within the door latch opening 20, i.e. positioned with only the angled portion 52 of the tongue portion 18 extending beyond the front edge 30 of the door 12. When the tongue portion 18 is inserted in the proper position relative to the door 12, the tongue portion 18 is the rotated clockwise, as viewed from the front edge 30 of the door 12, so that the two tabs 56 provided on each side of the cylindrical front end 32 of the handle portion 16 move into two of the intersecting slots, i.e. either intersecting slots 50A and 50B, or alternately, intersecting slots 50B and 50C, that are provided associated with each elongated slot 44. The tabs 56 will enter either the first two intersecting slots 50A and 50B or the last two intersecting slots 50B and 50C depending on whether the larger bore 22 is located approximately 2⅜ inches or approximately 2¾ inches from the front edge 30 of the door 12.

When the tabs 56 enter the intersecting slots 50A and 50B or alternately 50B and 50C, this locks the tongue portion 18 to the handle portion 16 and also serves to rotate the angled portion 52 of the tongue portion 18 to the proper orientation relative to the door frame 54, i.e. so that the angled portion 52 faces toward the door frame 54. This completes the installation of the temporary latch 10 in the door latch opening 20.

Figure 2:
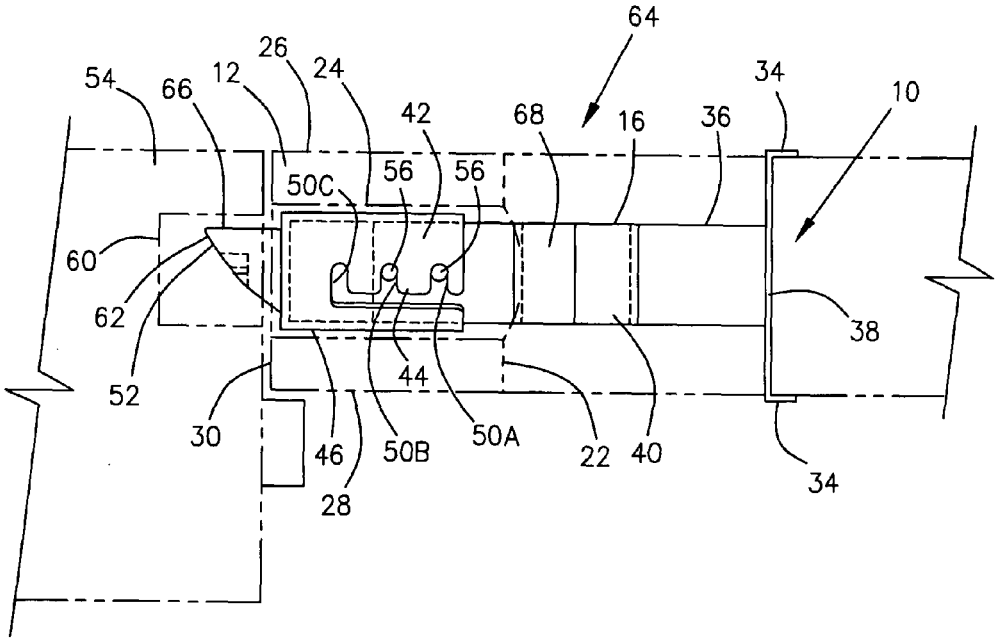
FIG. 2 is a top view of the temporary latch of FIG. 1, shown as it would appear with the door in which it is being used in a closed position relative to the door jam and with the latch extended to its locked position.
Figure 3:
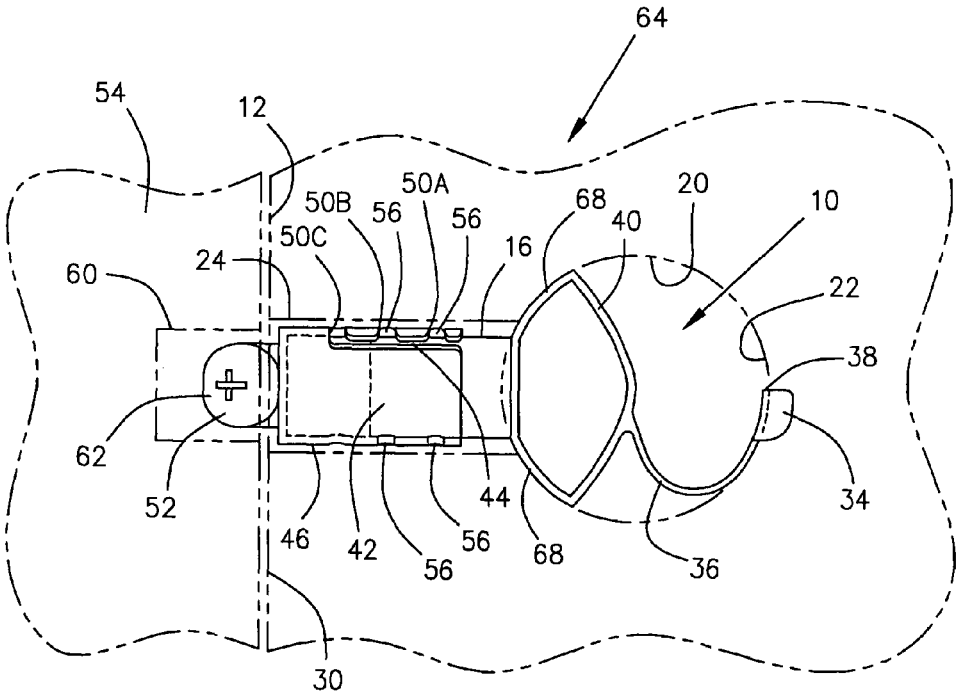
FIG. 3 is a side view of the temporary latch of FIG. 2.

The door frame 54 is provided with tongue receiving opening 60 therein that is vertically aligned with the angled portion 52 of the tongue portion 18 and into which the tongue 62 inserts to thereby latch the door 12 in a closed position 64, as illustrated in FIGS. 2 and 3. To lock the door 12 in its closed position 64 with the temporary latch 10, the door 12 is simply closed. As the door closes, the angled portion 52 of the tongue 62 encounters the door frame 54. This causes the tongue portion 18 to be pushed inward inside the smaller bore 24 and the compressible arm 36 to be compressed. As the tongue 62 is received into the small bore 24, the door 12 completely closes with the door frame 54.

As the door 12 closes, the tongue 62 encounters the tongue receiving opening 60 and the compressible arm 36 biases the tongue 62 forward into the tongue receiving opening 60. Once the tongue 62 enters the tongue receiving opening 60, the door 12 is latched shut in its locked or closed position 64. Because a long side 66 of the tongue 62 located opposite or on the back side of the tongue 62 from the angled portion 52 is not angled, the door 12 will remain latched in its closed position 62 until the tongue 62 is again fully retracted within the smaller bore 24.

Figure 4:
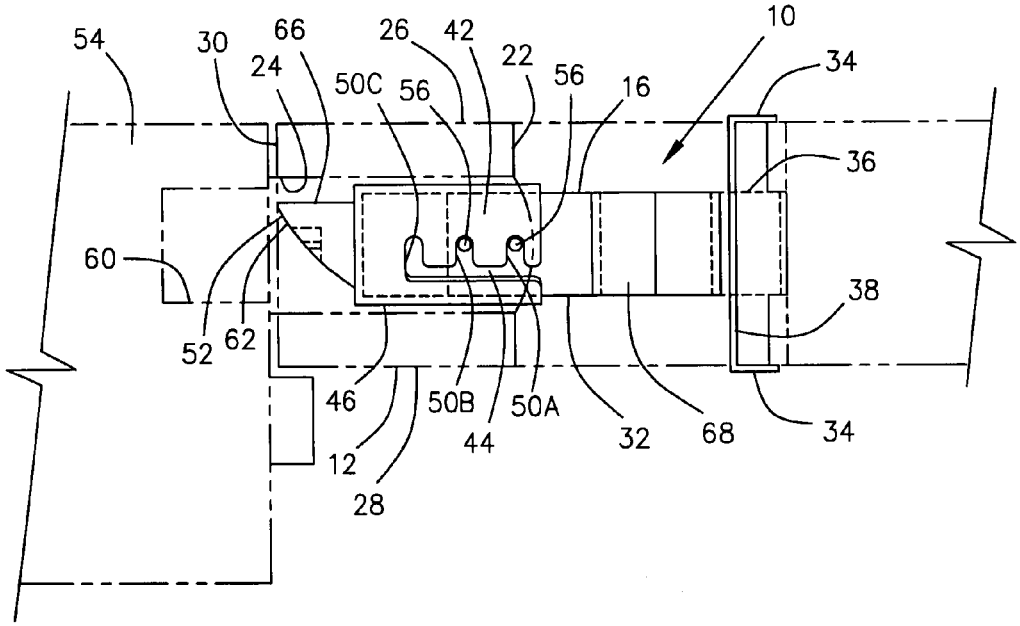
FIG. 4 is a top view of the temporary latch of FIG. 2, shown with the latch retracted to its unlocked position.
Figure 5:
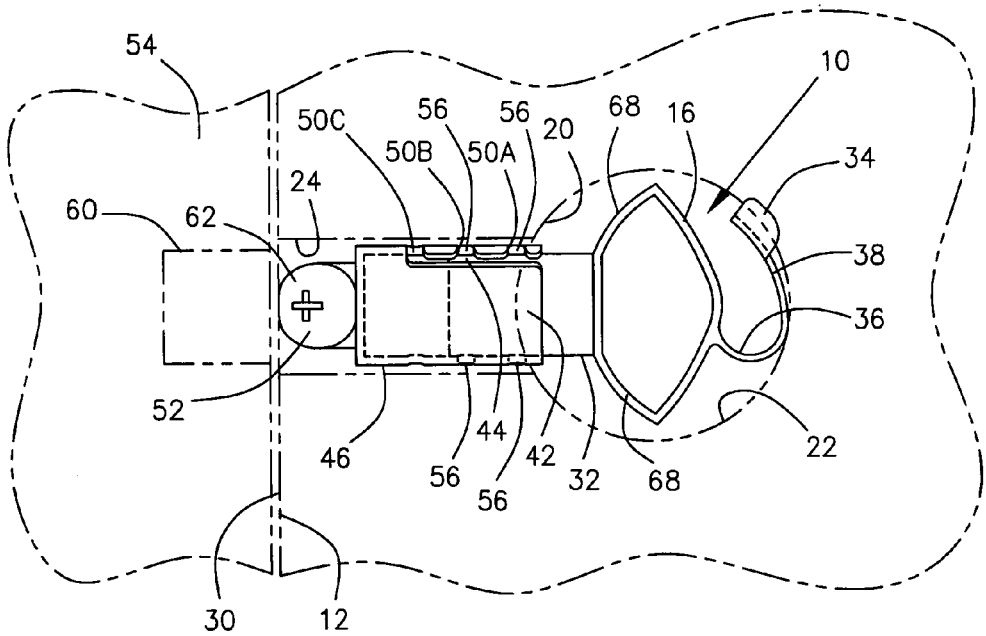
FIG. 5 is a side view of the temporary latch of FIG. 4.

In order to open the door 12 from its closed position 62, the operator must grasp the circular part or ring 40 of the handle portion 16 and, by pushing or pulling on the ring 40, must bias the handle portion 16 rearward within the large bore 22. As illustrated in FIGS. 4 and 5, this causes the tongue 62 to be retracted within the small bore 24, unlocking the door 12 so that it can be opened by swinging the door 12 away from the door frame 545. When the operator releases the ring 40, the arm 36 biases the tongue 62 forward so that the angled portion 52 again extends beyond the front edge 30 of the door 12.

The ring 40 is provided with shoulders 68 that extend upward and downward within the large bore 22 and prevent the ring 40 from entering the smaller bore 24, thereby properly positioning the tongue 62 so that it does not extend too far beyond the front edge 30 of the door 12.

To remove the temporary door latch 10 from the door 12 so that a permanent door latch (not illustrated) can be installed in the door 12, the tongue portion 18 of the temporary latch 10 is first disengaged from the handle portion 16 by rotating the tongue portion 18 counterclockwise until the two tabs 56 on each side of the handle portion 16 move out of the intersecting slots 50A and 50B or alternately 50B and 50C and into the elongated slot 44. Once the tabs 56 are in the elongated slots 44, the tongue portion 18 is then removed from the smaller bore 24 by pulling the tongue portion 18 out of the door latch opening 20 via the front edge 30 of the door12.

Once the tongue portion 18 has been removed from the handle portion 16, the handle portion 16 is removed from the larger bore 22 by first biasing the compressible arm 36 toward the ring 40 so that the ears 34 on the compressible arm 36 can be disengaged from the larger bore 22 and then the handle portion 16 can be pulled out of the door latch opening 20 on either side 26 or 28 of the door 12.

While the invention has been described with a certain degree of particularity, it is manifest that many changes may be made in the details of construction and the arrangement of components without departing from the spirit and scope of this disclosure. It is understood that the invention is not limited to the embodiments set forth herein for the purposes of exemplification, but is to be limited only by the scope of the attached claim or claims, including the full range of equivalency to which each element thereof is entitled.

What is claimed is:

1. A temporary door latch comprising:

a handle portion removably engaged with a tongue portion, means for biasing said tongue portion in a direction away from a rear end of said handle portion being provided on said handle portion, a compressible arm provided on said handle portion so that said tongue portion moves toward said handle when the compressible arm is compressed, and at least two ears provided at the rear end of the compressible arm to removably secure the handle portion within a larger bore of a door latch opening.

2. A temporary door latch comprising:

a handle portion removably engaged with a tongue portion, means for biasing said tongue portion in a direction away from a rear end of said handle portion being provided on said handle portion, a compressible arm provided on said handle portion so that said tongue portion moves toward said handle when the compressible arm is compressed, and a ring attached to said compressible arm for ease in grasping the handle portion in order to compress the compressible arm rearward within the larger bore of the door latch opening as a means of retracting the tongue portion rearward.

3. A temporary door latch comprising:

a handle portion removably engaged with a tongue portion, and means for biasing said tongue portion in a direction away from a rear end of said handle portion being provided on said handle portion;

at least one tab provided on a cylindrical front end of said handle portion, and at least one slot provided in a rear end of said tongue portion so that each tab of the handle portion is removably received in a corresponding slot of the tongue portion when the handle portion and tongue portion are removably secured together.

4. A temporary door latch according to claim 3 wherein each said slot further comprises:

an elongate slot that extends parallel to a longitudinal axis of the tongue portion, and at least one intersecting slot continuous with its corresponding elongated slot and approximately perpendicular to its corresponding elongated slot.

5. A temporary door latch according to claim 3 wherein each tab of the handle portion enters an associated elongated slot on the tongue portion when the handle portion is telescopically received in the tongue portion and so that the handle portion and tongue portion are removably locked together by rotating the tongue portion so that the each tab enters an associated intersecting slot.

6. A temporary door latch comprising:

a handle portion removably engaged with a tongue portion, a compressible arm provided on said handle portion so that said tongue portion moves toward said handle when the compressible arm is compressed, a tongue provided on a front end of said tongue portion, and said tongue provided with an angled portion for slidably engaging a door frame of the door, said tongue provided with a long side that is located on an opposite side of the tongue from the angled portion to prevent the door from opening when the tongue is engaged with a tongue receiving opening provided in a door frame for the door, a ring attached to said compressible arm for ease in grasping the handle portion in order to compress the compressible arm rearward within the larger bore of the door latch opening as a means of retracting the tongue portion rearward, and at least two ears provided at the rear end of the compressible arm to removably secure the handle portion within a larger bore of a door latch opening.

7. A temporary door latch comprising:

a handle portion removably engaged with a tongue portion, a compressible arm provided on said handle portion so that said tongue portion moves toward said handle when the compressible arm is compressed, a tongue provided on a front end of said tongue portion, and said tongue provided with an angled portion for slidably engaging a door frame of the door, said tongue provided with a long side that is located on an opposite side of the tongue from the angled portion to prevent the door from opening when the tongue is engaged with a tongue receiving opening provided in a door frame for the door, a ring attached to said compressible arm for ease in grasping the handle portion in order to compress the compressible arm rearward within the larger bore of the door latch opening as a means of retracting the tongue portion rearward, and at least one tab provided on a cylindrical front end of said handle portion, and at least one slot provided in a rear end of said tongue portion so that each tab of the handle portion is removably received in a corresponding slot of the tongue portion when the handle portion and tongue portion are removably secured together.

8. A temporary door latch according to claim 7 wherein each said slot further comprises:

an elongate slot that extends parallel to a longitudinal axis of the tongue portion, and at least one intersecting slot continuous with its corresponding elongated slot and approximately perpendicular to its corresponding elongated slot.

9. A temporary door latch according to claim 8 wherein each tab of the handle portion enters an associated elongated slot on the tongue portion when the handle portion is telescopically received in the tongue portion and so that the handle portion and tongue portion are removably locked together by rotating the tongue portion so that the each tab enters an associated intersecting slot.

* * * * *